US006289661B1

(12) United States Patent
Boland

(10) Patent No.: US 6,289,661 B1
(45) Date of Patent: Sep. 18, 2001

(54) WIRE GUIDE HOLDER

(75) Inventor: Peter Boland, Harwinton, CT (US)

(73) Assignee: Kamatics Corporation, Bloomfield, CT (US)

( * ) Notice: Subject to any disclaimer, the term of this patent is extended or adjusted under 35 U.S.C. 154(b) by 0 days.

(21) Appl. No.: 09/456,757

(22) Filed: Dec. 7, 1999

(51) Int. Cl.[7] ..... D01H 7/86

(52) U.S. Cl. ..... 57/58.63; 57/58.52; 57/58.54; 57/67; 57/71; 57/115

(58) Field of Search ..... 57/58.52, 58.54, 57/58.63, 67, 71, 115; 140/30, 149

(56) References Cited

U.S. PATENT DOCUMENTS

| | | | |
|---|---|---|---|
| 6,461 | 5/1849 | Abbot . | |
| 81,064 | 8/1868 | Bolster . | |
| 2,599,356 | 6/1952 | Wild . | |
| 3,019,590 | 2/1962 | Brame . | |
| 3,413,795 | 12/1968 | Breuning . | |
| 3,945,182 | 3/1976 | Dover et al. . | |
| 4,072,003 | 2/1978 | Mino . | |
| 4,302,924 | 12/1981 | Faulstich . | |
| 4,434,945 | 3/1984 | Hamane et al. . | |
| 5,509,260 | 4/1996 | Derdeyn . | |
| 5,809,763 * | 9/1998 | Rowlands et al. | 57/115 |

FOREIGN PATENT DOCUMENTS

| | | |
|---|---|---|
| 618 486 A5 | 7/1980 | (CH) . |
| 0 569 730 A1 | 11/1993 | (EP) . |
| 5-247861(A) | 9/1993 | (JP) . |
| 09158070 * | 6/1997 | (JP) . |

* cited by examiner

*Primary Examiner*—John J. Calvert
*Assistant Examiner*—Shaun R Hurley
(74) *Attorney, Agent, or Firm*—Cantor Colburn LLP

(57) ABSTRACT

In accordance with the present invention there is provided a wire guide holder for use with a flyer bow comprising a clamp having a base having a first surface for placement adjacent the flyer bow and a second surface in opposition to the first surface. A first gripping flange extends from the base and a second gripping flange extends from the base. The first and second gripping flanges secure the wire guide holder to the flyer bow without the need for fasteners through the flyer bow. A guide eye engaged to the base. The wire guide holder for use with a flyer bow further comprises a clamping system including a plurality of straps; at least one fastener for securing a first strap of the plurality of straps to a second strap of the plurality of straps about the flyer bow; and a guide eye engaged therebetween.

5 Claims, 5 Drawing Sheets

WIRE GUIDE HOLDER

BACKGROUND OF THE INVENTION

This invention relates to wire guide holders in flyer bows. Flyer bows for use on twisting machines are well known in the art. Twisting machines with flyer bows can be used to make twisted cables for a wide variety of uses. Flyer bows, including those related to this invention, can be used with pairing, tripling, quadding, bunching and twisted machines for wires.

A typical construction and operation of a twisting machine and flyer bow is disclosed and described in U.S. Pat. No. 3,945,182, the entire contents of which are incorporated herein by reference. As described in U.S. Pat. No. 3,945,182, a typical flyer bow is arcuate along its length and transversely flat. That is, it is generally rectangular, or at least has opposed flat parallel faces, and it is arcuate along its length. U.S. Pat. No. 3,945,182 discloses the feature of incorporating a groove or recess in the inside surface of the flyer bow and a corresponding ridge or protrusion on the outer surface of the flyer bow. The wires to be twisted nest within the groove to protect the wires from windage that sweeps transversely across the flyer bow as it rotates along its orbital path around a longitudinal axis.

Typical prior art flyer bows have wire guides mounted on the inner surface. These wire guides are typically semicircular in shape and present a flat and blunt exposed air surface. The prior art wire guides may be secured to the flyer bow by nuts which extend above the top surface of the flyer bow and are exposed to air as the flyer bow rotates. All of this creates drag of the flyer bow as it rotates.

Previous wire guide holders have been attached to the flyer bow by way of screws and holes drilled into the flyer bow at fixed locations along the flyer bow. This causes a weakening of the flyer bow structure, requires the use of additional metal fasteners and lacks the ability to locate the wire guides at optimal locations along the flyer bow. In particular, European Pat. Application (Pub. No. 0 569 730 A1) discloses a flyer comprising a body having a flat cross section and having an aerodynamic profile, made of suitable mechanically strong material and provided with a longitudinal median channel on whose bottom there is fitted a strip made of steel or other suitable material and which is closed by another strip made of steel or other suitable material, which is kept equidistant from and parallel to the preceding strip by bushes made of ceramic or other suitable material, disposed between the said strips at the sides of the channel. The strips are fixed to the body of the flyer by means of screws, rivets or other suitable means which pass through the bushes.

In Swiss Patent No. CH-618-486 there is disclosed a double twisting wire cable machine having a loop or lyre equipped with a cable guide tube having a branching off, connected to a fluid delivery pipe. The fluid reduces cable friction along the length of the loop and may comprise an emulsion of liquid in air or other gas, or a mist of oil transported in air. U.S. Pat. No. 81,064 discloses an Improved Bearing for Speeder-Fliers having a flier-rail, it being formed with a female screw, cut in it, to receive the male screw of the flier-bearing. In Japanese Patent No. 5-247861 an invention is disclosed to obtain the subject flier bow reduced in weight by firmly laminating the surface of the flier bow body formed by deflecting a metallic belt plate to arch shape with a rigid resin plate.

SUMMARY OF THE INVENTION

In accordance with a first aspect of the invention there is provided a wire guide holder for use with a flyer bow comprising a clamp having a base having a first surface for placement adjacent the flyer bow and a second surface in opposition to the first surface. A first gripping flange extends from the base and a second gripping flange extends from the base. The first and second gripping flanges secure the wire guide holder to the flyer bow without the need for fasteners through the flyer bow or a guide eye engaged to the base. In accordance with a second aspect of the present invention there is provided a clamping system including a plurality of straps, at least one fastener for securing a first strap of the plurality of straps to a second strap of the plurality of straps about the flyer bow; and a guide eye engaged therebetween.

BRIEF DESCRIPTION OF THE DRAWINGS

Referring now to the drawings, wherein like elements and features are numbered alike in the several Figures.

DESCRIPTION OF THE PREFERRED EMBODIMENT

Figure 1:
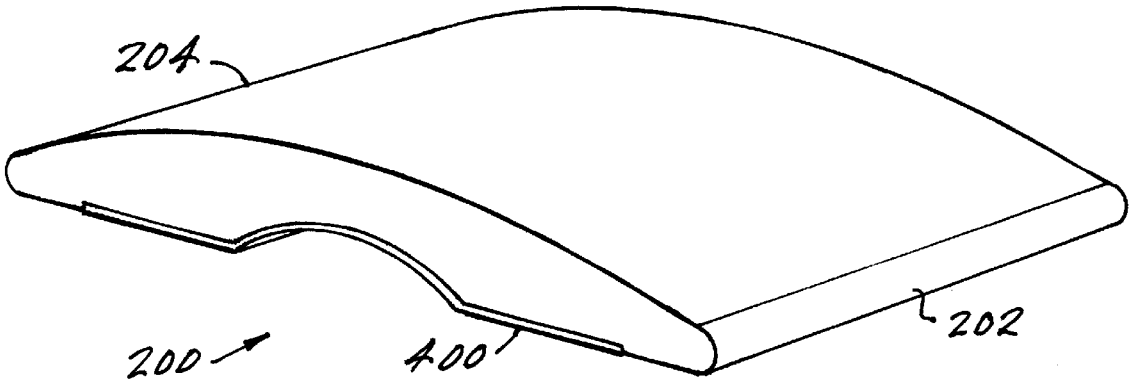
FIG. 1 (PRIOR ART)
FIG. 1 is a three dimensional representation in cross section of an element of a typical flyer bow.
Figure 2:
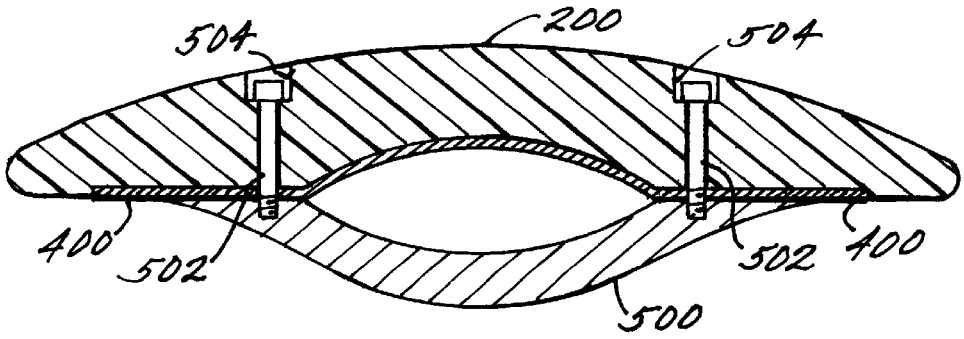
FIG. 2 (PRIOR ART)
FIG. 2 is a cross sectional representation of a typical flyer bow and a typical wire guide attached thereto by way of screws passing through the flyer bow.

A description of the preferred embodiment of the present invention will now be had, by way of exemplification and not limitation, with reference to FIGS. 1 through 9. FIG. 1 is a three dimensional representation in cross section of an element of a typical flyer bow 200. The flyer bow 200 includes a first segment 202 (e.g., a leading edge) and a second segment 204 (e.g., a trailing edge). Furthermore, as seen in FIG. 1 there is attached to the flyer bow 200 a typical wear strip 400. FIG. 2 is a cross sectional representation of a typical flyer bow 200 and typical wire guide 500 showing holes 502 extending therethrough for receiving screws 504 for mating the flyer bow 200 and the wire guide 500. The aforesaid holes 502 tend to weaken the structure of the flyer bow 200 and prevents the flyer bow from operating at maximum rotational speed for best production efficiency.

Figure 3:
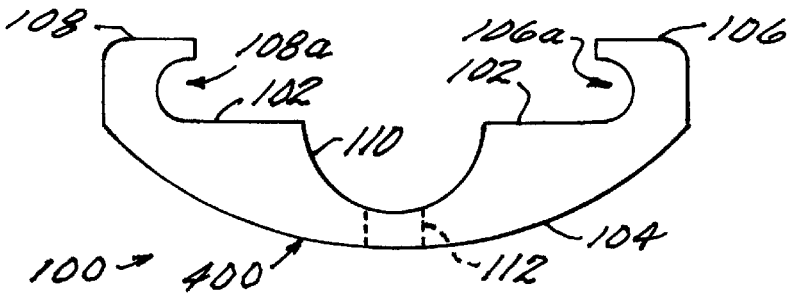
FIG. 3 is a front view of the clamp of the present invention.
Figure 5:
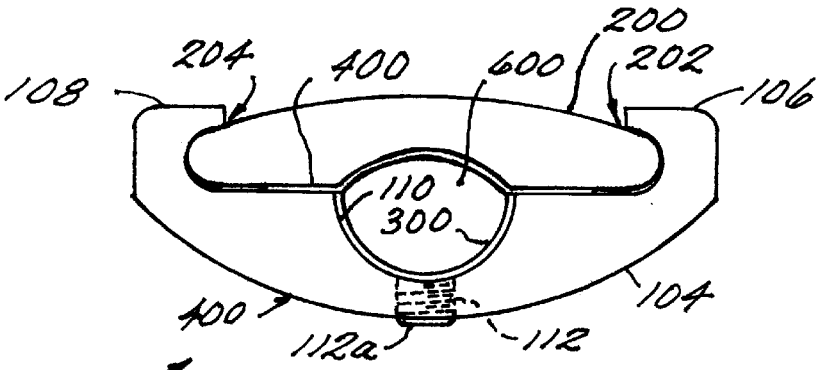
FIG. 5 is a partial cross sectional view of a wire guide holder mounted to the flyer bow.

Referring now to FIG. 3, therein depicted is side view of a clamp 100. The clamp 100 is comprised of a base 400 having a first surface 102 and a second surface 104 in opposition to the first surface 102. The first surface 102 is positioned adjacent to a bottom surface of the flyer bow 200 as shown in FIG. 5. The second surface 104 may be aerodynamically shaped to reduce drag. The clamp 100 also includes a first gripping flange 106 extending from the base 400 and a second gripping flange 108 also extending from the base 400. The first gripping flange 106 and the second gripping flange 108 are so formed as to define respectively a first semi-open channel 106*a* and a second semi-open channel 108*a*.

Figure 4:
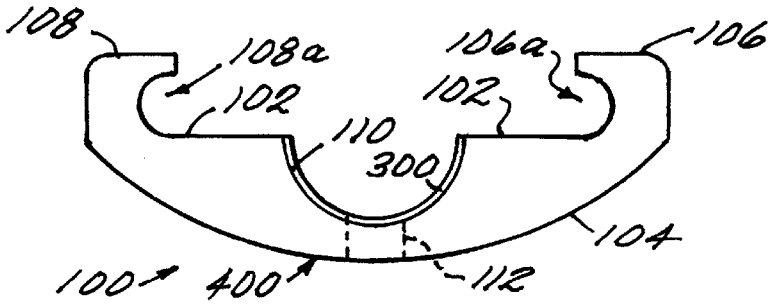
FIG. 4 is a front view of the clamp fitted with a guide eye.
Figure 6:
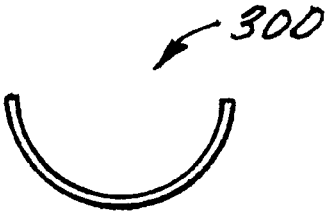
FIG. 6 is a front view of the guide eye.
Figure 7:
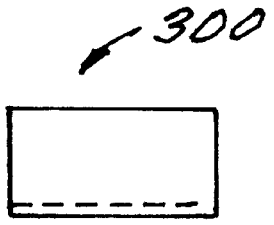
FIG. 7 is a side view of the guide eye.

It is seen in FIG. 3 that the first surface 102 includes a recessed groove 110 adapted to receive a guide eye 300 of FIG. 6 and FIG. 7. The guide eye 300 may be made from a ceramic or other suitable material and is generally U-shaped. Such reception of the guide eye 300 by the recessed groove 110 is shown in FIG. 4. The clamp 100 is of sufficient ductility so as to allow the clamp 100 to be affixed to the flyer bow 200 in such a manner that the first semi-open channel 106*a* and the second semi-open channel 108*a* securely receive respectively the first segment 202 and the second segment 204 of the flyer bow 200. The clamp may be made of such a material as Polyethylene Terephthalate or other suitable material. Such clamping of the clamp 100 to the flyer bow 200 is accomplished without the need for forming holes into the flyer bow 200 and is displayed in FIG. 5. Also seen in FIG. 5, as a result of such clamping, is the juxtaposition of the guide eye 300 of the present invention and the wear strip 400 so as to form therefrom an enclosure 600 operative to guide thereby a wire (not shown in the interest of clarity).

Still further in FIG. 5, it is seen that the clamp 100 includes at least one hole 112 formed through the clamp 100 and operative to receive a first fastener 112*a*, such as a set screw, for further securing the clamp 100 to the flyer bow 200.

Figure 8:
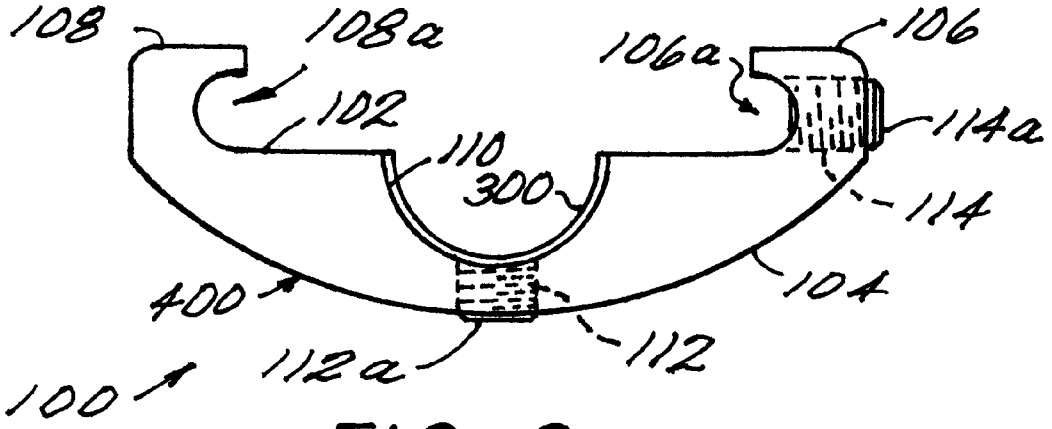
FIG. 8 is a front view of a second embodiment of the clamp.

Referring now to FIG. 8, therein depicted is the clamp 100 including a second hole 114 therethrough at the first gripping flange 106 and operative to receive a second fastener 114*a*, such as a set screw, for further securing the clamp 100 onto the flyer bow 200. It should be understood from FIG. 8, that a second hole 114 may be located in either the first gripping flange 106 or the second gripping flange 108 or both.

Figure 9:
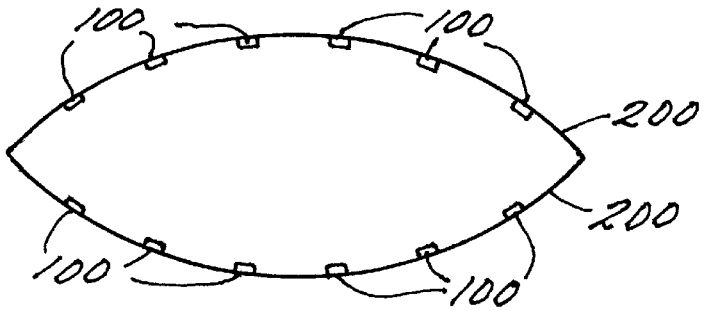
FIG. 9 depicts a flyer bow with a plurality of clamps attached thereto.
Figure 10:
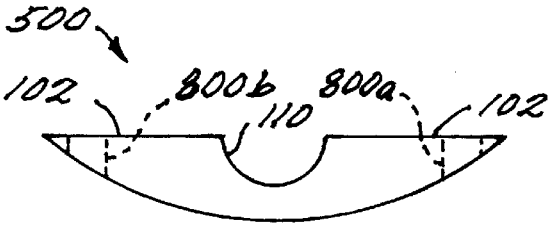
FIG. 10 is a cross sectional view of a first strap of the present invention.
Figure 10A:
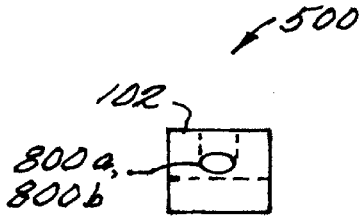
FIG. 10A is a cross sectional view of the strap of FIG. 10.
Figure 11:
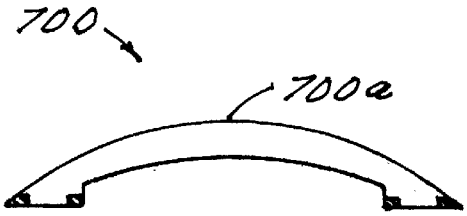
FIG. 11 is a cross sectional view of a second strap of the present invention.
Figure 11A:
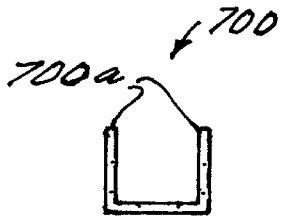
FIG. 11A is a cross sectional view of the second strap of FIG. 11.

Referring now to FIG. 9, therein depicted is a drawing of a plurality of flyer bows 200 with a plurality of clamps 100 attached thereto. As best understood from FIG. 9, the plurality of clamps 100 are variably located along the flyer bows 200. The placement of and, if necessary, the subsequent relocation of the clamps 100 along the flyer bows 200 is easily accomplished with the present invention by a simple adjustment of the fastener 112*a* or if necessary the second fastener 114*a* allowing the clamp 100 to be slid into the appropriate position along the flyer bow 200.

Figure 12:
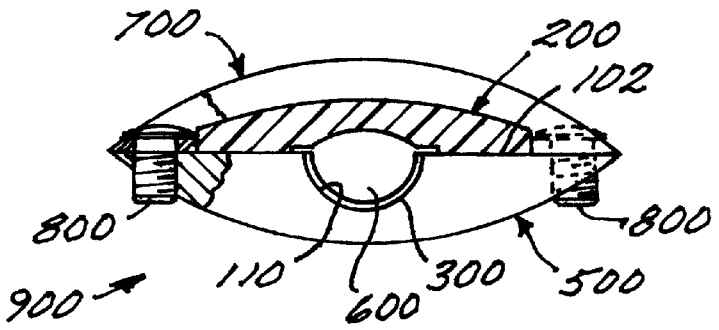
FIG. 12 is a cross sectional view of an assembled strap system of the present invention.
Figure 13:
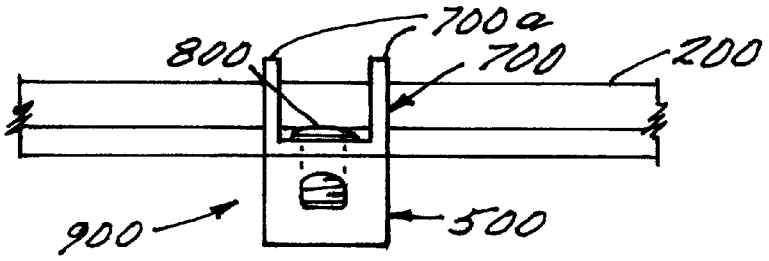
FIG. 13 is a first cross sectional view of the assembled strap system of FIG. 12.
Figure 14:
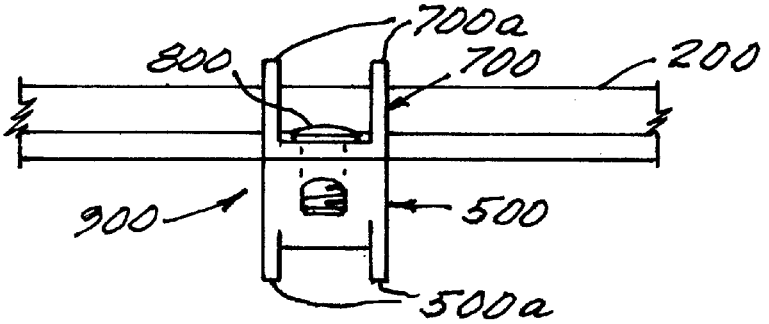
FIG. 14 is a second cross sectional view of the assembled strap system of FIG. 12.

Reference will now be had to FIG. 12. Therein depicted is an assembled clamping system 900 comprising a first strap 500, a second strap 700, a guide eye 300 and at least one fastener 800. In the interest of clarity, the first clamp 500 and the second clam 700 are shown in a disassembled view in FIGS. 10, 10A, 11 and 11A. In FIG. 12 the first strap 500 includes a first surface 102 having a recessed groove 110 adapted to receive the guide eye 300 of FIG. 6 and FIG. 7. In FIG. 13 and FIG. 14 the second strap 700 comprises a first set of stiffening rails 700*a* and in FIG. 14 the first strap further comprises a second set of stiffening rails 500*a*. As mentioned above, the guide eye 300 may be made of a ceramic or other suitable material and is generally U-shaped in nature. The assembled clamping system 900 is such that the plurality of fasteners 800 secure the first and second straps 500, 700 to one another about the flyer bow 200 whereby the guide eye 300 is juxtaposed between the flyer bow 200 and the first clamp 500 so as to form thereby an enclosure 600 operative to guide a wire(not shown) therethrough.

The assembled clamping system 900 is such that the stiffening rails 500*a*, 700*a* create the lowest drag. In addition, the assembled clamping system 900 can be clamped onto the flyer bow 200 at any location without the need for drilling holes in the flyer bow 200 as shown in FIG. 9.

What is claimed is:

1. A wire guide holder for use with a flyer bow comprising:

a clamping system including
- a plurality of straps;
- at least one fastener for securing a first strap of the plurality of straps to a second strap of the plurality of straps about the flyer bow; and
- a guide eye engaged therebetween.

2. The wire guide holder as set forth in claim 1 wherein the plurality of straps comprises:

a first strap having a first surface for placement adjacent the flyer bow and a second surface in opposition to the first surface; and a second strap having a third surface for placement adjacent the flyer bow and a fourth surface in opposition to the third surface.

3. The wire guide holder as set forth in claim 2 wherein the first surface includes a recessed groove adapted to receive the guide eye.

4. The wire guide holder as set forth in claim 2 wherein the first strap further comprises a first set of stiffening rails.

5. The wire guide holder as set forth in claim 2 wherein the second strap further comprises a second set of stiffening rails.

* * * * *